United States Patent [19]

Perrin et al.

[11] Patent Number: 4,843,459

[45] Date of Patent: Jun. 27, 1989

[54] METHOD AND DEVICE FOR THE DISPLAY OF TARGETS AND/OR TARGET POSITIONS USING DATA ACQUISITION MEANS OF A WEAPONS SYSTEM

[75] Inventors: Jacques Perrin, Montigny-Le-Bretonneux; Pascal Sinaud, Wissous, both of France

[73] Assignee: Thomson-LSF, Paris, France

[21] Appl. No.: 91,591

[22] Filed: Aug. 31, 1987

[30] Foreign Application Priority Data

Sep. 9, 1986 [FR] France ..... 86 12618

[51] Int. Cl.[4] ..... H04N 7/18

[52] U.S. Cl. ..... 358/93; 358/105; 358/108; 358/110; 244/3.13; 244/3.16; 342/45; 342/53; 342/55; 340/980

[58] Field of Search ..... 358/105, 108, 110, 93; 244/3.11, 3.13, 3.14, 3.16; 342/55, 45, 50, 53; 360/980, 7.5; 102/334

[56] References Cited

U.S. PATENT DOCUMENTS

| | | | |
|---|---|---|---|
| 3,440,651 | 4/1969 | Fluhr et al. | 342/45 |
| 3,567,163 | 3/1971 | Kepp | 244/3.14 |
| 3,598,344 | 8/1971 | Walters et al. | 244/3.11 |
| 3,742,812 | 7/1973 | Woodworth et al. | 89/1.56 |
| 3,912,198 | 10/1975 | Dell et al. | 244/3.16 |
| 4,004,487 | 1/1977 | Eichweber | 244/3.15 |
| 4,096,380 | 6/1978 | Eichweber | 358/109 |
| 4,146,196 | 3/1979 | Schultz | 244/3.19 |
| 4,324,491 | 4/1982 | Hueber | 356/152 |
| 4,540,140 | 9/1985 | Levy et al. | 342/424 |
| 4,630,049 | 12/1986 | Callahan et al. | 242/45 |
| 4,634,271 | 1/1987 | Jano et al. | 244/3.13 |
| 4,694,297 | 9/1987 | Sewards | 342/45 |

FOREIGN PATENT DOCUMENTS

| | | |
|---|---|---|
| 3334729 | 4/1985 | Fed. Rep. of Germany . |
| 2004038 | 3/1979 | United Kingdom . |
| 2103341 | 2/1983 | United Kingdom . |
| 2143931 | 2/1985 | United Kingdom . |

OTHER PUBLICATIONS

J. Philip Geddes, "Un Nouveau Depart pour le Missile Maverick", Revue Internationale de Defense, vol. 14 (1981) No. 11, pp. 1463–1468.

*Primary Examiner*—James J. Groody
*Assistant Examiner*—John K. Peng
*Attorney, Agent, or Firm*—Roland Plottel

[57] ABSTRACT

The invention pertains mainly to a method and a device for the display of targets and/or target positions using the data acquisition means of a weapons system.

The device of the present invention can be used to display the target or the direction of the target acquired by missile homing heads. This data comes as a complement, and other data on the position of the target is used to ascertain that the homing head is properly locked on as well as to supplement any lack of information caused, for example, by a breakdown in the display systems. The invention can be applied mainly to the building of anti-aircraft defense launching platform or anti-aircraft and anti-tank launching platform.

12 Claims, 2 Drawing Sheets

FIG. 3
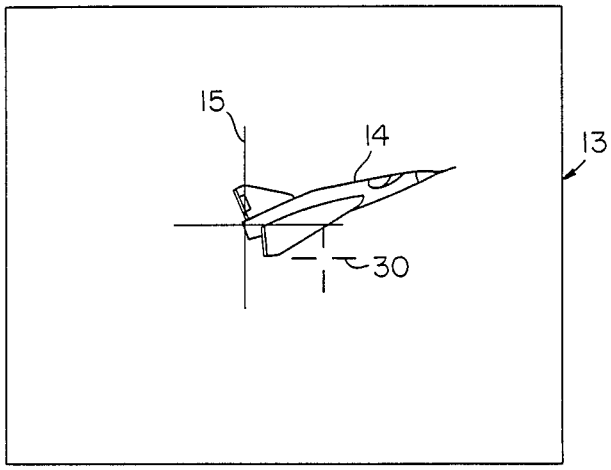
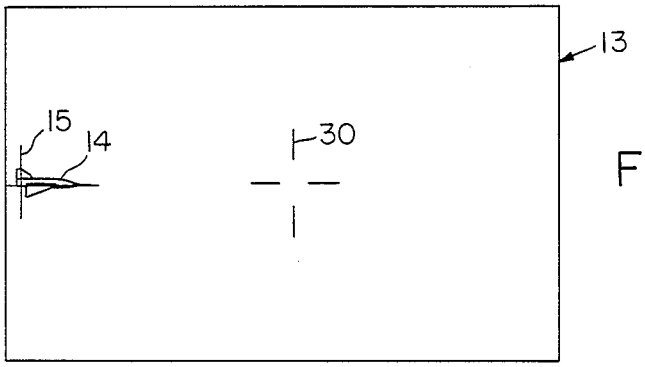
FIG. 4
FIG. 5
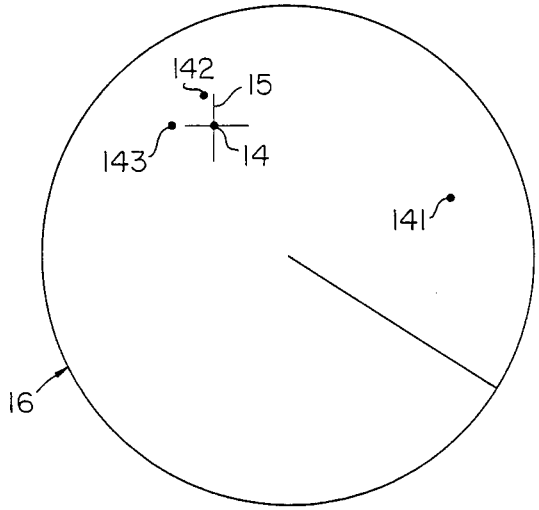

METHOD AND DEVICE FOR THE DISPLAY OF TARGETS AND/OR TARGET POSITIONS USING DATA ACQUISITION MEANS OF A WEAPONS SYSTEM

BACKGROUND OF THE INVENTION

1. Field of the Invention

The invention pertains chiefly to a method and a device for the display of targets and/or target positions using data acquisition means of a weapons system.

2. Description of the Prior Art

Means exist in the prior art for fitting missiles with data acquisition means used to locate targets in azimuth and elevation.

There also exist data acquisition means in the prior art, used to display a target and/or target position before a missile is launched.

These data acquisition means make it possible:

to identify a target as a friend or foe and to make a choice of enemy targets which are sought to be destroyed as a priority:

to lock the data acquisition means of the missile onto the chosen target;

to ascertain that the data acquisition means of the missile are properly locked onto the target aimed at.

The device of the present invention can be used, before the missile is launched, to gather information from the data acquisition means of the missile to complement data gathered by the data acquisition means of the launching platform (especially the fire control means).

The device of the present invention can be used, in particular, to gather additional data on the target, for example data from a sensor in another frequency band, to collect information when the data acquisition means at the launching site are not pointed towards the target or when the data acquisition means have been destroyed.

SUMMARY OF THE INVENTION

The main object of the invention is a device to launch missiles with homing heads comprising display means, a device essentially comprising means to display the targets and/or target positions, given by the missile, on the display means Another object of the invention is a method for the display of targets and/or target positions on the display means of a missile-launching platform, a method wherein the data acquisition means of a weapons system are used.

BRIEF DESCRIPTION OF THE DRAWINGS

The invention will be better understood from the following description and the appended figures, given as non-exhaustive examples, of which:

FIG. 3 is a diagram of a display screen:;

FIG. 4 is a diagram of an example of data contained in a display screen;

FIG. 5 is a diagram of an example of data contained in a display screen.

FIGS. 1 to 5 use the same reference numerals to designate the same elements.

DESCRIPTION OF THE PREFERRED EMBODIMENT

Figure 1:
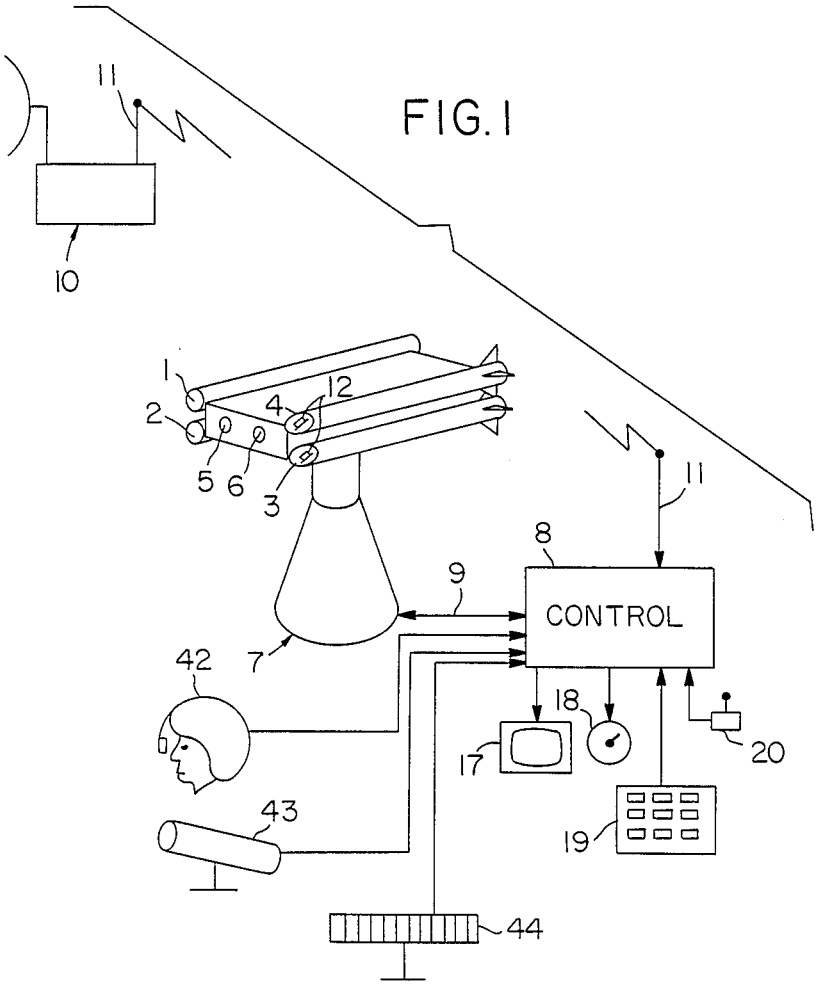
FIG. 1 is an example of a missile-launching platform according to the invention comprising several data acquisition means.

FIG. 1 shows a launching platform 7 for missiles 1, 2, 3 and 4. The missiles 1, 2, 3 and 4 are, for example, anti-aircraft missiles. The launching platform 7 is connected by a line 9 to a control device 8. The control device 8 comprises, in particular, a computer capable of gathering data which are transmitted to it and of sending control signals, through a line 9, to the servo-control circuits of the launching platform 7.

The launching platform 7 has data acquisition means, for example a camera 5, which is sensitive in a visible spectrum, as well as an infra-red camera 6. Furthermore, the control device 8 is advantageously connected to other data acquisition devices such as, for example, a radar 10, an optical device 42 (helmet) for target-designation, a laser telemeter 43 or an identification friend-or-foe device 44 (IFF). In the example of FIG. 1, the radar 10 is connected to the control device 8 by radio-electrical communications means 11.

The control device 8 is linked to man/machine interfaces. For example, the device 8 is linked to a cathode tube screen 17 used to display pictures gathered by the cameras 5 and/or 6, a circular scanning screen 18 used to display the information gathered by the radar 10, a keyboard 19 and a control stick 20.

There are several types of missiles, especially missiles comprising an infra-red homing head, a radar homing head, a visible spectrum homing head or an image-processing device. During the procedure for firing a missile, for example the missile 4, towards an aircraft (not shown in the diagram):

The homing head 12 of the missile 4 is activated;

The launching platform 7 is aimed in the direction of the aircraft so that the homing head 12 can be locked into the aircraft;

The launching platform 7 is aimed so that the missile 4 has a lead angle enabling the interception of the aircraft.

When the firing platform 7 is pointed, enabling the missile 4 to take a lead angle, the television cameras 5 and 6 are no longer aimed in the direction of the missile. Thus, it is no longer possible to ascertain, up to the moment of firing, if the homing head 12 of the missile 4 is still locked onto the target.

The homing head 12 may be unlocked, for example, by the motion of the firing platform 7, by sudden evasive action by the aircraft, or if the aircraft goes behind an obstacle, such as a clump of trees for example, or again if the homing head 12 gets locked into a more powerful radiation source such as another aircraft or decoys.

In gathering and displaying data transmitted by the homing head 12 of the missile 4 before firing, the control device 8 makes it possible to ascertain, right up to the instant of firing, that the homing head 12 is properly locked onto the target aimed at.

Furthermore, the device of the present invention can be used for operation in a restricted mode. Thus, the operator can always point the firing platform 7 towards an aircraft by means of the control stick 20, if the television cameras 5 and 6 are unavailable. It suffices, for example, to superimpose a crosshair 15 on the screen 17, indicating the position of a target given by data acquisition means of the missile (homing head) with the center of the screen corresponding to the direction in which the turret is pointed.

In an alternative embodiment of the device according to the invention, the control device 8 automatically aims the firing platform 7 towards the aircraft on the basis of the data transmitted by the homing head 12.

It is understood that the homing head 12 can transmit data only if it is activated. The homing head of the missile is activated by using a sequencer, which is included, for example, in the control device 8. Thus, the automatic aiming of the firing platform is particularly advantageous when using infra-red homing heads which have a limited lifetime.

FIG. 1 shows the missiles 1 and 2 in storage containers. It is clear that the homing heads 12 of the missiles 1 and 2 can collect data only after the shielding tubes have been jettisoned. The missiles 3 and 4 correspond to an alternative embodiment with no shelding tubes.

The use of another type or other types of missiles, or of a greater number of missiles, is not beyond the scope of the present invention.

Figure 2:
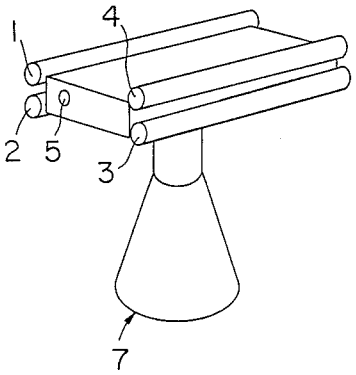
FIG. 2 is a perspective view of a launching pad comprising a single data-acquisition means.

FIG. 2 shows a firing platform 7 comprising four missiles 1, 2, 3 and 4 and a television camera 5. The television camera 5 is, for example, a camera sensitive to visible light. Thus the firing platform 7 of FIG. 2 is an economical version of the firing platform 7 of FIG. 1. These performances are below those of the firing platform 7 of FIG. 1, especially at night. In the example of the use of missiles comprising a passive infra-red homing head, it is possible, at night, to use the homing head to determine the position of the target, take the decision to fire, and give the missiles a lead angle for the interception of the target.

FIG. 3 shows an example of data displayed by a display scren 13. The display screen 13, a cathode tube for example, shows an aircraft 14 as well as a crosshair 15. The aircraft 14 is, for example, automatically tracked by the firing platform 7 in azimuth and in elevation. The crosshair 15 shows the aiming position of the homing head of the missiles. Should the picture of the aircraft 14 be unusable, the crosshair 15 can be superimposed on the center of the screen 13 to make the pad 7 point in the direction of the aircraft 14. Advantageously, the superimposition of the crosshair 15 on the center of the screen 13 is facilitated by the presence of a crosshair 30 at the center.

FIG. 4 shows an example of data displayed by a display screen when introducing a lead angle for the pad 7. The aircraft 14 is no longer at the center of the screen 13. In the example illustrated by the FIG. 4, the enlargement obtained by the television camera, for example the camera 5, is smaller than the enlargement in FIG. 3. The aircraft is at the edge of the image. The crosshair 15 is superimposed on the aircraft 14. Depending on its distance and speed, the aircraft may completely disappear from the screen 13. In this case, the crosshair 15 may be found, for example, at the edge of the picture.

FIG. 5 shows the display screen of a radar (plan position indicator PPI). The radar screen 16 shows four echoes 14, 141, 142 and 143. In the example illustrated in FIG. 5, the operator has chosen the aircraft corresponding to the echo 14 as a target. Thus, once the locking-on operation is done, the crosshair 15 is superimposed on the screen 16 at the echo 14.

The invention is not limited to anti-aircraft defense equipment. The invention also applies to land, sea or combined (land, sea and air) targets. The invention can be applied to platform 7 for the launching of missiles 1, 2, 3 and 4 comprising a homing head 12, means for the display of targets 5, 6, 10, 13 and 16.

The device according to the present invention can be applied mainly to anti-aircraft defense platform comprising missiles with passive infra-red homing devices 12, as well as to anti-aircraft firing or anti-tank firing platform.

What is claimed is:

1. A system for launching a missile with a homing head, comprising a launching platform (7);

a plurality of sensors (5,6,10) coupled to the platform (7);

a missile (1-4), having a homing head (12), mounted on the platform (7);

display means (17) for displaying target position and missile position and orientation information, and control means (8), communicating with and receiving target position information from said homing head (12), for displaying said target position information on said display means (17), whereby said system can be aimed, when said sensors (5,6,10) coupled to the platform are disabled, by using information communicated by said homing head (12).

2. A system according to claim 1 wherein the data acquisition means comprise at least one television camera (5, 6).

3. A system according to claim 2 wherein the television camera is an infra-red camera (6).

4. A system according to claim 1 wherein the data acquistion means comprise a laser telemeter (43).

5. A system according to claim 1 wherein the data acquisition means comprise a friend-or-foe identification device (44).

6. A device according to claim 1 further comprising data acquisition means, coupled to said control means, and including at least one optical helmet (42) for target designation.

7. A system according to claim 1 wherein the missile homing head (12) is a passive, infra-red homing head.

8. A system according to claim 1 wherein information on the target position is displayed as a crosshair (15).

9. A system according to claim 1 wherein the center of the screen is shown as a crosshair (30).

10. A system according to claim 1 wherein the image of the target and the data on the position of the target make it possible to check the locking on of the homing head to the target when the missile takes its lead angle.

11. A system according to claim 1 wherein the missile is an anti-aircraft missile.

12. A method for the display of targets and target positions on a display means (17,18) of a missile launching platform (7) having at least one sensor (5, 6) thereon, comprising the steps of providing on said platform a missile having a homing head (12) and a transmitter connected to an output of said homing head;

transmitting (11) target position information from said homing head (12) to a platform control means (8);

aiming the missile launching platform toward a target; and displaying on said display means target position information, received from said homing head (12), regardless of whether said at least one platform sensor (5, 6) is operative.

* * * * *